US006503017B1

(12) United States Patent
Liu

(10) Patent No.: US 6,503,017 B1
(45) Date of Patent: Jan. 7, 2003

(54) INK REGULATING APPARATUS IN A PEN

(76) Inventor: Chen-Chou Liu, PO Box 82-144, Taipei (TW)

( * ) Notice: Subject to any disclaimer, the term of this patent is extended or adjusted under 35 U.S.C. 154(b) by 0 days.

(21) Appl. No.: 10/050,960

(22) Filed: Jan. 22, 2002

(51) Int. Cl.[7] ..... B43K 8/08
(52) U.S. Cl. ..... 401/199; 401/205; 401/207
(58) Field of Search ..... 401/199, 205, 401/207, 223, 225, 227

(56) References Cited

U.S. PATENT DOCUMENTS 4,923,317 A * 5/1990 Bishop et al. ..... 401/205
5,336,010 A * 8/1994 Shiomitsu ..... 401/199
5,352,051 A * 10/1994 Tamura et al. ..... 401/227 X
5,906,446 A * 5/1999 McCulloch et al. ..... 401/199
6,276,860 B1 * 8/2001 Nakajima et al. ..... 401/199

* cited by examiner

*Primary Examiner*—David J. Walczak
*Assistant Examiner*—Kathleen J. Prunner
(74) *Attorney, Agent, or Firm*—Leong C. Lei

(57) ABSTRACT

An ink regulating apparatus in a pen, injection molded from high-density plastic grains, comprised of three or more than three gradations retreating downward by control of density in the molding process with the lowest one tapered to slowly and gradually deliver the ink when inserted into a pen-holder to prevent ink leakage, warrant fluent writing and leaves no residual ink when the pen is discarded.

3 Claims, 6 Drawing Sheets

INK REGULATING APPARATUS IN A PEN

BACKGROUND OF THE INVENTION (a) Field of the Invention

The present invention is related to an ink regulating apparatus in a pen, and more particularly, to one that warrants writing fluency, prevents ink leakage, and leaves no residual ink when the pen is discarded.

(b) Description of the Prior Art

As seen from a sign pen, a marker and other pens generally available in the market, it is usually comprised as illustrated in FIG. 1 of the accompanying drawings. Wherein, a spiral element 13 is provided between a pen-holder 12 and a point 11 for the ink contained in the pen-holder 12 is first retained by the spiral element 13 before slowly flowing to the point 11 for achieving the ink regulation purpose. The regulation of ink in the spiral element 13 is done by air control. However, it fails to precisely achieve its purpose of regulating the flow of the ink. Therefore, upon accidental jolt of the penholder, wild spillage of the ink nay happen. As taught in a U.S. Pat. (No. 4,457,644), a regulating element 23 made of fibers is provided between a penholder 21 and a point 22. It achieves the same purpose of regulating the ink flow. However, either fails to prevent spillage of ink when the penholder is accidentally jolted. When the pen is discarded, there exits residual ink to cause pollution problems to the environment. Furthermore, both of the penholders 12, 23 require comparatively higher production and dies development cost.

SUMMARY OF THE INVENTION

The primary purpose of the present invention is to provide an ink regulating apparatus for a pen to deliver the ink by permeation for fluent writing without leakage and leaving no residual ink for environmental protection. Furthermore, the present invention features low production cost, fast dies development and easy process. To achieve the purpose, the regulating apparatus is comprised of an element injection molded from high-density plastic grains. Density is controlled in the molding process. Being inserted between the pen-holder and the pen point, the regulating apparatus is integrated with the pen-holder to allow the delivery of ink at slow permeation to prevent accidental spillage of ink even the pen-holder is violently jolted. The regulating element is made having three or more than three of gradations retreating downward with the bottom gradation tapered to allow permeation of the ink.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 2:
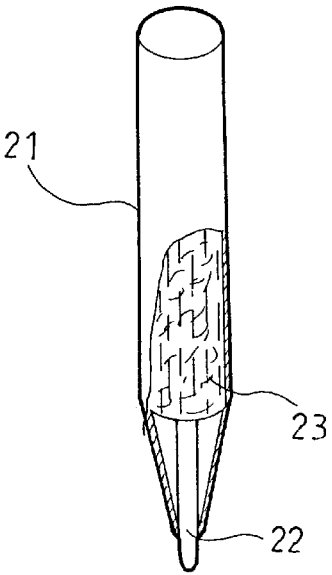
PRIOR ART FIG. 2
FIG. 2 is a sectional view showing another pen of the prior art.
Figure 2A:
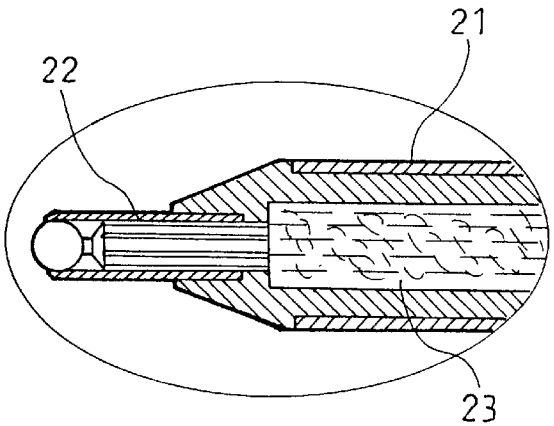
PRIOR ART FIG. 2A
FIG. 2A is an enlarged sectional view of a portion of FIG. 2.
Figure 1:
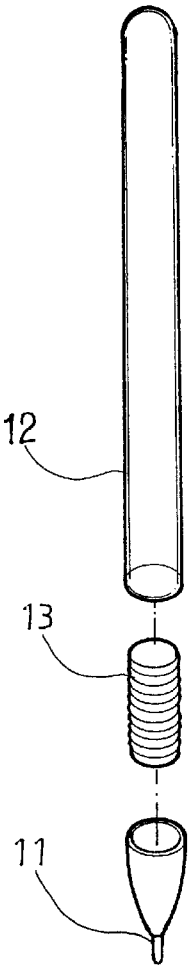
PRIOR ART FIG. 1
FIG. 1 is an exploded view showing a pen of the prior art.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 3, 4, 5 and 6, the present invention is essentially comprised of an ink regulating element 3, which is injection molded from high-density plastic grains. The density is controlled during the molding process. Wherein, depending on the concentration of the ink, the dies are heated for approximately ten minutes and then opened after another ten minutes of cooling process. The time and number of each cycle of heating and cooling may vary depending on the concentration of the ink for the regulating element 3 to be controlled at a certain density.

The regulating element 3 is made into three levels retreating downward to respectively from gradations 31, 32 and 33 for a first, a second and a third levels. Within, the gradation 32 is tapered while the bottom level, i.e. the third level indicates a cylindrical shape. When the regulating element 3 is inserted into a penholder 4, a lever 5, a fibrous member 6 and a point 7 are provided in sequence below the bottom of the regulating element 3. The ink then flows slowly by permeation thanks to the high-density feature of the regulating element 3. Since the configuration of the regulating element 3 indicates retreating downward, it achieves better control of the flowing speed of the ink to ensure fluent writing without any leakage even when the penholder 4 is violently jolted. Furthermore, as the ink is delivered to the point 7 by permeation, it flows only when the point 7 contacts the paper. That is, the ink stays put when the pen is not used. Furthermore, the regulating element 3 is tightly integrated with the inner edge of the penholder 4, meaning, the ink flows only through the regulating element 3. When the ink is consumed up, there will be no residual ink in the penholder 4; therefore, any discarded pen will not create pollution to the environment.

Figure 7:
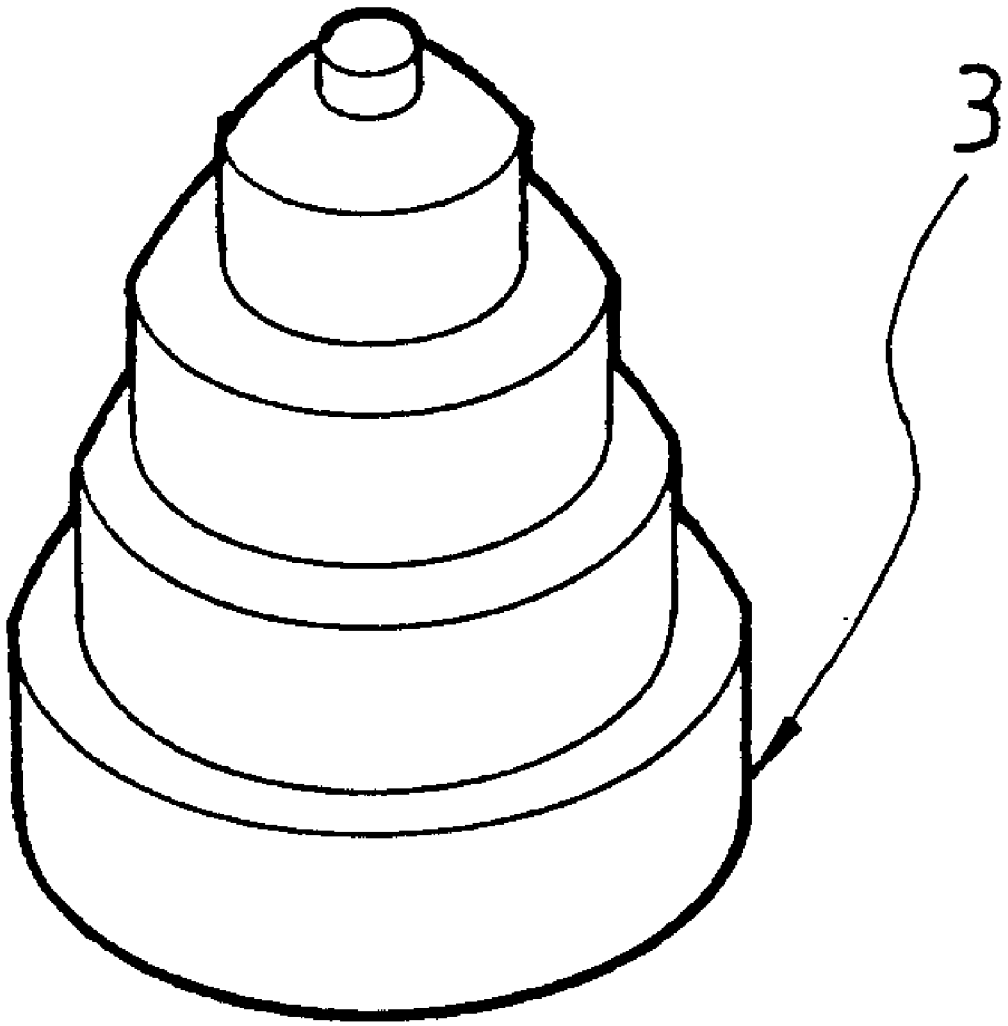
FIG. 7 is a view showing another preferred embodiment of the present invention.

Now referring to FIG. 7, the regulating element 3 of the present invention is made into a multi-level configuration. Similarly, the bottom level is in cylindrical and the second level tapered to alter the amount of ink flow in adaptation to various types of the pen by increasing the length of the regulating element 3.

Figure 3:
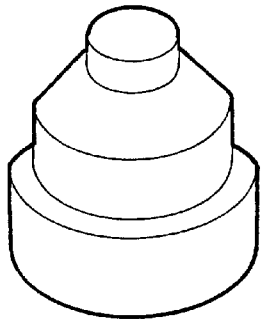
FIG. 3 is a perspective view showing a preferred embodiment of the present invention.
Figure 4:
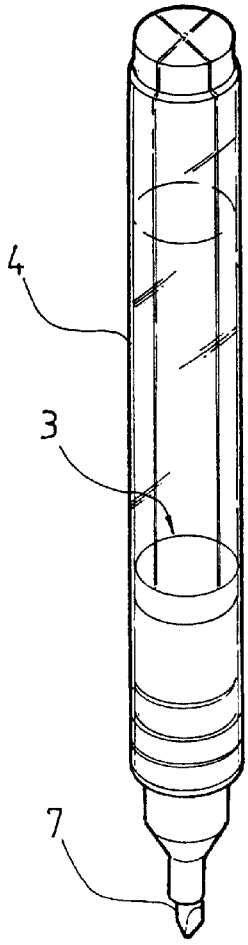
FIG. 4 is a perspective view showing that a pen contains the preferred embodiment of the present invention.
Figure 5:
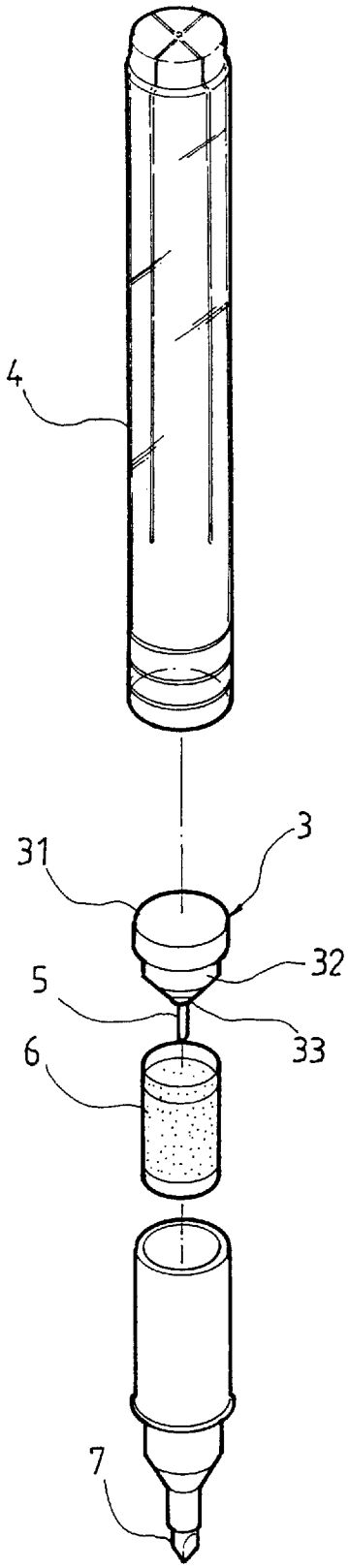
FIG. 5 is an exploded view showing that the pen contains the preferred embodiment of the present invention.
Figure 6:
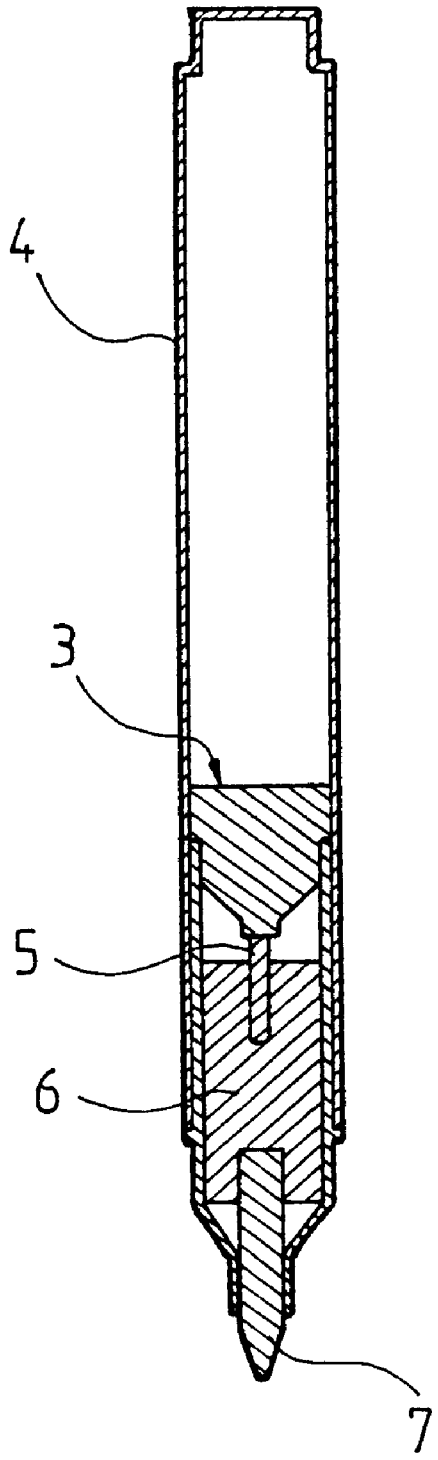
FIG. 6 is a sectional view showing the pen taken from FIG. 5.

To ensure fluent writing of the pen, it is preferred that the height among any two abutted levers of the gradations of the regulating element 3 follows the ration of 1:1 for achieving the optimal ink permeation speed as illustrated in FIGS. 3 and 7.

Figure 8:
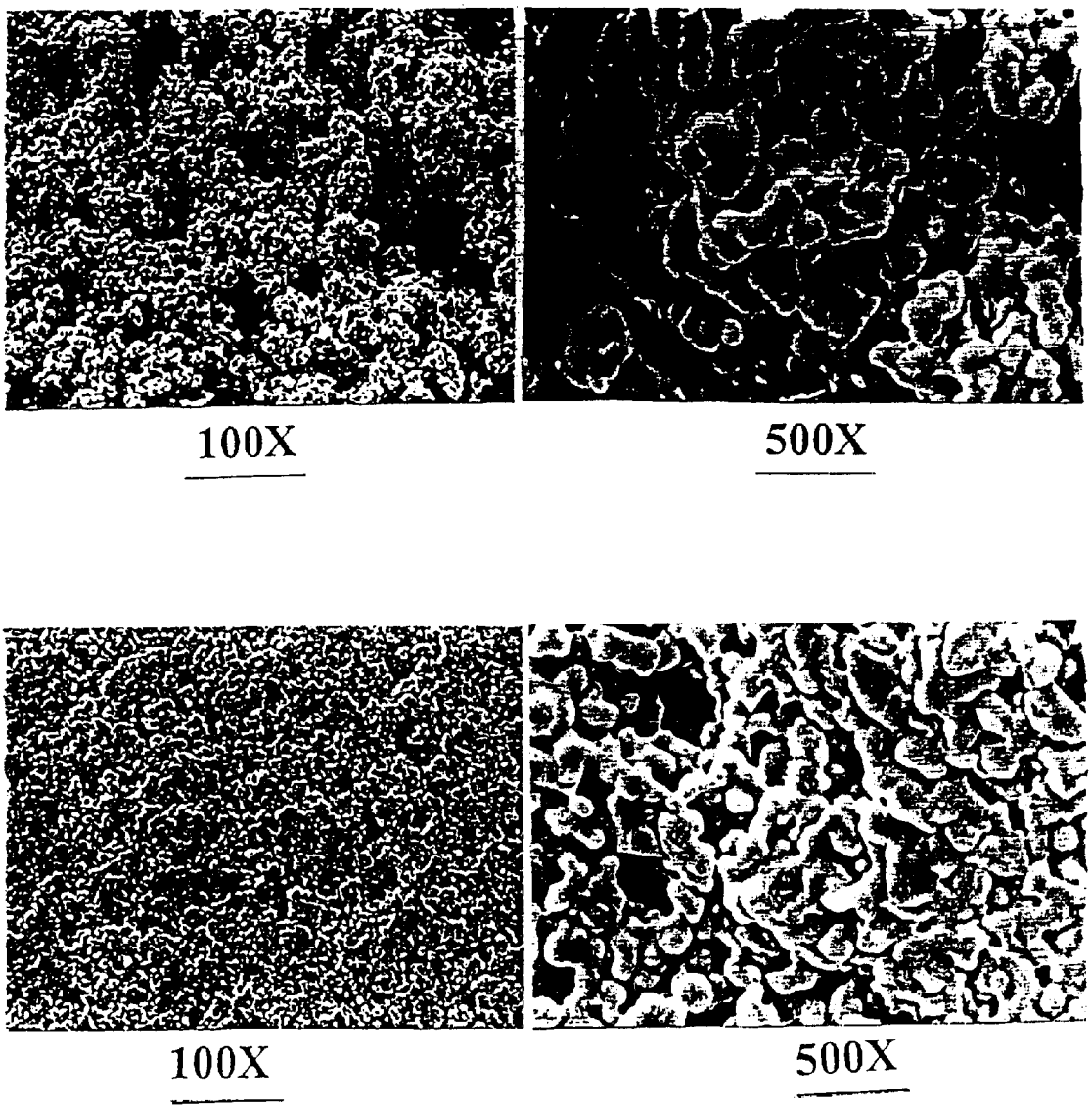
FIG. 8 is a blowout view showing density of the present invention.

As illustrated in FIG. 8, a specified density in the regulating element 3 is achieved by consistent distribution of plastic grains for a slow and uninterrupted permeation of the ink through the regulating element 3.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An ink regulating apparatus in a pen essentially comprised of an injection molded element of high-density plastic grains; the element being molded into three or more than three gradations with each gradually retreating downward; the gradation at the bottom indicating cylindrical shape and the second gradation tapered to allow the ink to slowly permeate for regulating purpose due to the height of the element when inserted into the pen-holder.

2. An ink regulating apparatus in a pen as claimed in claim 1, wherein, the height difference among the gradations of the element is approximately 1:1.

3. An ink regulating apparatus in a pen as claimed in claim 1, wherein, depending on the concentration of the ink used, the dies used for the regulating element during the molding process is heated for approximately ten minutes and then cooled for another ten minutes to achieve the purpose of control of the density of the element.

* * * * *